US010646052B2

(12) United States Patent
Taylor et al.

(10) Patent No.: US 10,646,052 B2
(45) Date of Patent: May 12, 2020

(54) ADJUSTABLE APPARATUS FOR PRODUCT DISPLAY

(71) Applicant: Walmart Apollo, LLC, Bentonville, AR (US)

(72) Inventors: Robert James Taylor, Rogers, AR (US); Jason Bellar, Bella Vista, AR (US); Jamison Lonnie Kyle Sibley, Rogers, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 15/831,687

(22) Filed: Dec. 5, 2017

(65) Prior Publication Data

US 2018/0199732 A1 Jul. 19, 2018

Related U.S. Application Data

(60) Provisional application No. 62/445,785, filed on Jan. 13, 2017.

(51) Int. Cl.

| | |
|---|---|
| ***A47F 1/12*** | (2006.01) |
| ***A47B 57/04*** | (2006.01) |
| ***A47F 7/00*** | (2006.01) |
| ***A47F 5/00*** | (2006.01) |
| ***A47B 65/00*** | (2006.01) |

(52) U.S. Cl.

CPC ..... *A47F 1/126* (2013.01); *A47B 57/04* (2013.01); *A47B 65/00* (2013.01); *A47B 65/10* (2014.12); *A47F 1/12* (2013.01); *A47F 5/005* (2013.01); *A47F 7/0014* (2013.01)

(58) Field of Classification Search

CPC ..... A47F 1/126; A47F 5/005; A47F 7/0014; A47F 1/12; A47B 57/04; A47B 65/10; A47B 65/00

USPC ..... 211/184

See application file for complete search history.

(56) References Cited

U.S. PATENT DOCUMENTS

| | | | | | |
|---|---|---|---|---|---|
| 1,424,080 | A * | 7/1922 | Carpenter | ..... | G06K 21/02 211/51 |
| 1,506,204 | A * | 8/1924 | Snoddy | ..... | A47B 65/20 211/43 |
| 1,780,872 | A * | 11/1930 | Dumben | ..... | A47B 65/00 108/28 |

(Continued)

*Primary Examiner* — Patrick D Hawn

(74) *Attorney, Agent, or Firm* — McCarter & English, LLP; David R. Burns

(57) ABSTRACT

An example adjustable product display apparatus is provided that includes a body configured to be mounted to a shelf. The body includes a proximal end, a distal end, a bottom surface extending between the proximal end and the distal end, and a top surface extending between the proximal end and the distal end at an angle relative to the bottom surface. The top surface is configured to support one or more products thereon. A distance between the bottom surface and the top surface increases from the proximal end to the distal and the distance at the distal end of the body defining a rear height of the body. The adjustable product display apparatus includes an expandable support disposed at the distal end of the body. Adjustment of the expandable support varies a height of the expandable support and simultaneously adjusts the rear height of the body.

18 Claims, 7 Drawing Sheets

(56) References Cited

U.S. PATENT DOCUMENTS 1,875,288 A * 8/1932 Welk et al. ..... A47B 23/043 211/43
1,883,974 A * 10/1932 Kusterle ..... A47B 23/04 108/10
2,225,830 A * 12/1940 Harris ..... B42D 17/00 211/42
2,516,122 A * 7/1950 Hughes ..... A47B 57/583 108/61
2,723,127 A * 11/1955 Hunziker ..... B41B 1/22 211/10
3,202,290 A * 8/1965 Harvey ..... A47B 65/10 211/184
3,704,848 A * 12/1972 Trebes ..... F16M 11/10 248/163.1
4,327,838 A * 5/1982 Cooke ..... A47B 57/586 108/61
4,463,854 A * 8/1984 MacKenzie ..... A47B 65/00 211/184
4,905,847 A * 3/1990 Hanson ..... A47B 57/58 211/184
5,000,326 A * 3/1991 Vaughn ..... A47F 7/0064 211/41.11
5,377,878 A * 1/1995 Rainey ..... B67D 3/0009 222/146.6
5,655,670 A * 8/1997 Stuart ..... A47B 57/58 108/61
5,660,362 A * 8/1997 Selby ..... F16M 7/00 248/188.4
5,788,090 A * 8/1998 Kajiwara ..... A47F 7/28 211/151
6,044,989 A 4/2000 Sosso
6,164,215 A 12/2000 Cook et al.
6,230,907 B1 * 5/2001 Stuart ..... A47B 55/02 108/108
6,454,106 B1 * 9/2002 Howard ..... A47B 45/00 211/43
6,902,140 B1 * 6/2005 Huang ..... E06C 7/44 248/188.2
6,979,240 B1 * 12/2005 Barton ..... B63H 20/007 297/423.46
7,117,997 B2 * 10/2006 Clover ..... F16M 11/041 211/41.15
7,275,662 B1 * 10/2007 Milcetich ..... B67D 3/0083 211/74
7,315,443 B2 * 1/2008 Allen ..... E05B 73/0082 211/8
7,324,333 B2 * 1/2008 Allen ..... E05B 73/0082 211/8
8,066,128 B2 11/2011 Crawbuck et al.
8,074,811 B2 * 12/2011 Schulman ..... A47B 17/06 211/11
8,517,191 B2 8/2013 Paeth
8,708,167 B2 * 4/2014 Mone ..... G10G 5/00 211/85.6
8,967,394 B2 3/2015 Hardy et al.
9,173,504 B2 11/2015 Hardy
9,364,103 B2 6/2016 Crabtree, II
9,593,801 B2 * 3/2017 Love ..... B67D 3/0051
2004/0178156 A1 * 9/2004 Knorring, Jr. ..... A47F 1/12 211/59.2
2004/0245197 A1 12/2004 McElvaney
2005/0011845 A1 * 1/2005 Ernst ..... A47F 5/01 211/150
2005/0150847 A1 7/2005 Hawkinson
2007/0102375 A1 * 5/2007 Rittmann ..... A47B 81/068 211/11
2007/0131633 A1 * 6/2007 Ferm ..... A47B 43/00 211/149
2008/0251482 A1 * 10/2008 Davis ..... A47F 5/01 211/186
2010/0158300 A1 * 6/2010 Wang ..... A47B 23/02 381/333
2011/0192840 A1 * 8/2011 Vazquez ..... A47F 7/08 220/4.21
2012/0080390 A1 * 4/2012 Schulman ..... A47B 17/06 211/11
2012/0080393 A1 * 4/2012 Eisman ..... A47B 43/00 211/86.01
2012/0085885 A1 * 4/2012 Song ..... G03B 21/145 248/676
2012/0152869 A1 * 6/2012 Phifer ..... A47B 23/044 211/40
2012/0217212 A1 * 8/2012 Czalkiewicz ..... A47F 1/12 211/59.2
2013/0276867 A1 * 10/2013 Wildes ..... H01L 31/048 136/246

* cited by examiner

ADJUSTABLE APPARATUS FOR PRODUCT DISPLAY

CROSS-REFERENCE TO RELATED APPLICATIONS

This application claims the benefit of commonly assigned U.S. Provisional Patent Application No. 62/445,785, which was filed on Jan. 13, 2017. The entire content of the foregoing provisional patent application is incorporated herein by reference.

BACKGROUND

Shelving systems are often utilized to support and display products. Some shelving systems are configured to hold multiple products stacked behind each other and to rely on gravity to move products forward towards the front of a shelf when a product at the front of the shelf has been removed. Sometimes products disposed with respect to these shelving systems can "hang" or do not automatically feed to the front of the shelf when the product at the front of the shelf has been removed, reducing visibility of available products to the customer and requiring a retail associate to manually urge the products forward.

SUMMARY

Exemplary embodiments of the present disclosure provide a product display apparatus including an expandable support that allows for adjustability of the product display apparatus. In particular, the product display apparatus includes a top surface extending between proximal and distal ends of the body. The top surface extends at an angle relative to the bottom surface. Using the expandable support at the rear of the product display apparatus, the rear height of the body can be adjusted, thereby simultaneously adjusting the angle of the top surface relative to the bottom surface. Based on the type of product being displayed, the angle can be adjusted to ensure sufficient gravitational force exists to urge the remaining products forward when the product at the front of the display has been removed. Thus, the configuration of the product display apparatus can be customized to accommodate a variety of product types without the need for using different product displays for each type of product.

In accordance with embodiments of the present disclosure, an exemplary adjustable product display apparatus is provided. The adjustable product display apparatus includes a body configured to be mounted to a shelf. The body includes a proximal end, a distal end, a bottom surface extending between the proximal end and the distal end, and a top surface extending between the proximal end and the distal end at an angle relative to the bottom surface. The top surface can be configured to support one or more products thereon. A distance between the bottom surface and the top surface increases from the proximal end to the distal and the distance at the distal end of the body defines a rear height of the body. The adjustable product display apparatus includes an expandable support disposed at the distal end of the body. Adjustment of the expandable support varies a height of the expandable support. Adjustment of the expandable support to vary the height of the expandable support simultaneously adjusts the rear height of the body.

Adjustment of the rear height of the body changes the angle of the top surface relative to the bottom surface. The angle of the top surface relative to the bottom surface can be adjustable with the expandable support by a range of up to, e.g., about forty-five degrees, about forty degrees, about thirty-five degrees, about thirty degrees, about twenty-five degrees, or the like. The expandable support can include a threaded opening formed in the body at or near the distal end and a foot including a threaded rod for threaded engagement into the threaded opening. Rotation of the rod of the foot in a first direction relative to the threaded opening of the body reduces the height of the expandable support. Rotation of the rod of the foot in a second direction relative to the threaded opening of the body increases the height of the expandable support.

The body includes first and second side walls extending between the proximal and distal ends. The first and second side walls can cover at least a portion of the expandable support. The body can include one or more rivets extending from the bottom surface configured for engagement with openings in a surface of the shelf for mounting the body to the shelf. In one embodiment, the body can include one or more magnets at or near the bottom surface configured to engage a surface of the shelf for mounting of the body to the shelf. In one embodiment, the expandable support can include a magnet configured to engage a surface of the shelf for mounting of the body to the shelf. In one embodiment, the adjustable product display apparatus can include an interlocking joint at the proximal end of the body configured to detachably mount the proximal end of the body to the shelf. In one embodiment, the top surface of the body can be pivotally coupled to the bottom surface at the proximal end.

In one embodiment, the top surface of the body can include a low friction surface configured to direct sliding of the one or more products along the top surface from the distal end to the proximal end. In one embodiment, the top surface of the body can include a plurality of rollers configured to direct movement of the one or more products along the top surface from the distal end to the proximal end. In one embodiment, the top surface of the body can include a spring-loaded pusher configured to direct movement of the one or more products along the top surface from the distal end to the proximal end.

In accordance with embodiments of the present disclosure, and exemplary adjustable product display system is provided. The adjustable product display system includes a shelf including a top surface and an adjustable product display apparatus. The adjustable product display apparatus includes a body configured to be mounted to the top surface of the shelf. The body includes a proximal end, a distal end, a bottom surface extending between the proximal end and the distal end, and a top surface extending between the proximal end and the distal end at an angle relative to the bottom surface. The top surface can be configured to support one or more products thereon. A distance between the bottom surface and the top surface increases from the proximal end to the distal end and the distance at the distal end of the body defines a rear height of the body. The adjustable product display apparatus includes an expandable support disposed at the distal end of the body. Adjustment of the expandable support varies a height of the expandable support. Adjustment of the expandable support to vary the height of the expandable support simultaneously adjusts the rear height of the body relative to the top surface of the shelf.

Adjustment of the rear height of the body changes the angle of the top surface relative to the bottom surface. The expandable support can include a threaded opening formed in the body at or near the distal end and a foot including a threaded rod for threaded engagement into the threaded opening. Threading the rod of the foot in a first direction relative to the threaded opening of the body reduces the height of the expandable support.

In accordance with embodiments of the present disclosure, an exemplary method of adjusting a product display is provided. The method includes mounting an adjustable product display apparatus to a top surface of a shelf. The adjustable product display includes a bottom surface extending between a proximal end and a distal end of the adjustable product display apparatus, and a top surface extending between the proximal end and the distal end at an angle relative to the bottom surface. The top surface can be configured to support one or more products thereon. A distance between the bottom surface and the top surface increases from the proximal end to the distal end and the distance between the bottom and top surfaces at the distal end of the body defines an adjustable rear height of the body. The method includes adjusting an expandable support disposed between the bottom surface and the top surface at the distal end to vary the adjustable rear height of the adjustable product display apparatus and increase or decrease the distance between the top surface and the bottom surface at the distal end.

Adjusting the rear height of the body changes the angle of the top surface relative to the bottom surface. The expandable support can include a threaded opening formed in the body at or near the distal end and a foot including a threaded rod for threaded engagement into the threaded opening. The method can include threading the rod of the foot in a first direction relative to the threaded opening of the body to reduce the height of the expandable support.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the adjustable product display, reference is made to the accompanying figures, wherein.

DETAILED DESCRIPTION

It should be understood that the relative terminology used herein, such as "front", "rear", "left", "top", "bottom", "vertical", "horizontal", "up" and "down" is solely for the purposes of clarity and designation and is not intended to limit embodiments to a particular position and/or orientation. Accordingly, such relative terminology should not be construed to limit the scope of the present disclosure. In addition, it should be understood that the scope of the present disclosure is not limited to embodiments having specific dimensions. Thus, any dimensions provided herein are merely for an exemplary purpose and are not intended to limit the invention to embodiments having particular dimensions.

Exemplary embodiments of the present disclosure provide a product display apparatus including an expandable support that allows for customizing a configuration of the product display apparatus by adjusting the rear height of the product display apparatus. In particular, the product display apparatus includes a top surface extending between proximal and distal ends of the body, the top surface extending at an angle relative to the bottom surface. Using the expandable support at the rear of the product display apparatus, the rear height of the body can be adjusted, thereby simultaneously adjusting the angle of the top surface relative to the bottom surface or the surface of a shelf upon which the product display apparatus rests. The product display apparatus can therefore be customized to be used for displaying different product types and can be adjusted to ensure sufficient gravitational force exists to urge the remaining products forward when the product at the front of the display has been removed.

Figure 1:
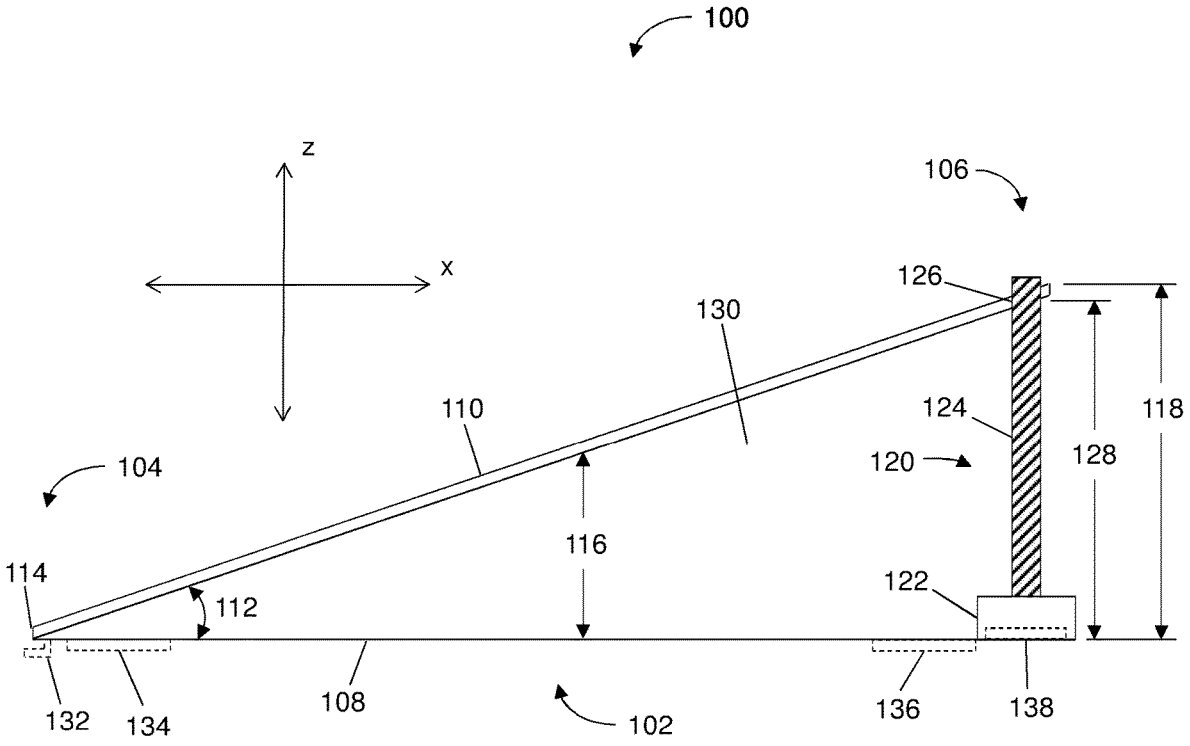
FIG. 1 is a diagrammatic side view of an exemplary adjustable product display of the present disclosure.

FIG. 1 is a diagrammatic side view of an exemplary adjustable product display apparatus 100 (hereinafter "apparatus 100") of the present disclosure. The apparatus 100 generally includes a body 102 configured to be mounted to a shelf. The body 102 includes a proximal end 104 and a distal end 106 on opposite sides of the body 102. A length of the product display apparatus 100 is defined by proximal and distal ends 104 and 106 measured along an x-axis. The body 102 includes a bottom surface 108 (e.g., a substantially planar surface) extending parallel to the x-axis between the proximal and distal ends 104, 106. The body 102 includes a top surface 110 (e.g., a substantially planar, plate-like surface) extending at an angle relative to the x-axis between the proximal and distal ends 104, 106. The top surface 110 is configured and dimensioned to support one or more products thereon.

While the present example of the product display apparatus 100 illustrates a continuous bottom surface 108 extending between the proximal and distal ends 104, 106, the bottom surface 108 may be discontinuously formed such that it does not extend the length of the body 102 and/or such that the bottom surface 108 is one more discrete segments. For example, the bottom surface 108 can include a first segment proximate to the proximal end 104 and a second segment proximate to the distal end 106 where the first and second segments are not continuously formed. Additionally, or in the alternative, a top surface of a shelf upon which the product display apparatus 100 may rest can form the bottom surface of the product display apparatus 100 according to embodiments of the present disclosure.

The top surface 110 extends at an angle 112 relative to the bottom surface 108. In particular, the body 102 can include a hinge joint or pivot point 114 at the connection of the bottom and top surfaces 108, 110 at the proximal end 104. A distance 116 between the bottom and top surfaces 108, 110, as measured parallel to a z-axis, increases from the proximal end 104 to the distal end 106. As will be discussed in greater detail below, the pivot point 114 allows movement between the bottom and top surfaces 108, 110 such that the distance 116 and the angle 112 between the bottom and top surfaces 108, 110 can be adjusted. Thus, the proximal end 104 of the bottom and top surfaces 108, 110 can be pivotally connected. A distance 118 between the bottom and top surfaces 108, 110 at the distal end 106 of the body 102 measured parallel to the z-axis defines the rear height of the body 102.

The apparatus 100 includes an expandable support 120 disposed at or adjacent to the distal end 106 of the body 102. The expandable support 120 can include a foot 122 configured to be disposed against an inner surface of the bottom surface 108 of the body 102. The expandable support 120 includes a threaded rod 124 extending from the foot 122. The top surface 110 includes a threaded opening 126 extending through the top surface 110 at or near the distal end 106. The threaded rod 124 can be configured to engage the complementary threaded opening 126 with a distance 128 defining the height of the expandable support 120. In particular, the height of the expandable support 120 is measured along the z-axis as the distance from the foot 122 to the inner surface of the top surface 110 wherein the rod 124 enters the opening 126.

Adjustment of the expandable support 120 varies the height or distance 128 of the expandable support 120. In particular, the rod 124 can be rotated clockwise or counterclockwise by rotating the foot 122. Rotation of the rod 124 in a first direction (e.g., clockwise) relative to the opening 126 threads the rod 124 further into the opening 126, thereby reducing the distance 128 of the expandable support 120. Rotation of the rod 124 in a second direction (e.g., counterclockwise) relative to the opening 126 threads the rod 124 out of the opening 126, thereby increasing the distance 128 of the expandable support 120.

Adjustment of the distance 128 simultaneously adjusts the distance 118 corresponding to the rear height of the body 102 and adjusts the angle 112 between the bottom and top surfaces 108, 110. In particular, the expandable support 120 provides support to the top surface 110 relative to the bottom surface 108. Reducing the distance 128 of the expandable support 120 reduces the distance 118 and the angle 112. Increasing the distance 128 of the expandable support 120 increases the distance 118 and the angle 112. In some embodiments, the angle 112 can be adjustable by up to about twenty degrees, about twenty-five degrees, about thirty degrees, about thirty-five degrees, about forty degrees, about forty-five degrees, or the like.

In some embodiments, the body 102 includes the bottom and top surfaces 108, 110 and the sides of the apparatus 100 are exposed. In some embodiments, the body 102 can include a first side wall 130 and a second side wall extending between the proximal and distal ends 104, 106 and at least partially covering the expandable support 120. For clarity, the second side wall is not shown in FIG. 1 to provide a view of the expandable support 120.

In some embodiments, the body 102 can include one or more attachment features 132 extending from the bottom surface 108 configured for engagement with openings in a surface of the shelf for mounting the body 102 to the shelf. In one embodiment, the attachment feature 132 can be in the form of a rivet that snap or friction fits within a corresponding opening in the shelf. In one embodiment, the attachment feature 132 can be in the form of an interlocking joint configured to detachably mount the proximal end 104 of the body 102 to the shelf. In one embodiment, the attachment feature 132 can be a forward facing hook (e.g., the hook shown in FIG. 1) configured to be slid into and engaged with the opening in the shelf. In some embodiments, the attachment feature 132 can extend from the inner surface of the top surface 110 and the top surface 110 can be engaged with the surface of the shelf directly without inclusion of the bottom surface 108.

In one embodiment, the body 102 can include one or more magnets 134, 136 at or near the bottom surface 108 configured to engage the mounting surface of the shelf for detachably mounting the apparatus 100 to the shelf. In one embodiment, the magnet 134 can be at or near the proximal end 104 of the bottom surface 108 and the magnet 136 can be at or near the distal end 106 of the bottom surface 108 to ensure a strong and stable mounting position at each end of the body 102. In one embodiment, the expandable support 120 can include one or more magnets 138 (e.g., a magnet 138 disposed in the foot 122) configured to engage the mounting surface of the shelf. Thus, the apparatus 100 can be securely mounted to the shelf and the expandable support 120 can be used to vary the distance 118, thereby customizing the apparatus 100 to support different types of products on the top surface 110.

Figure 2:
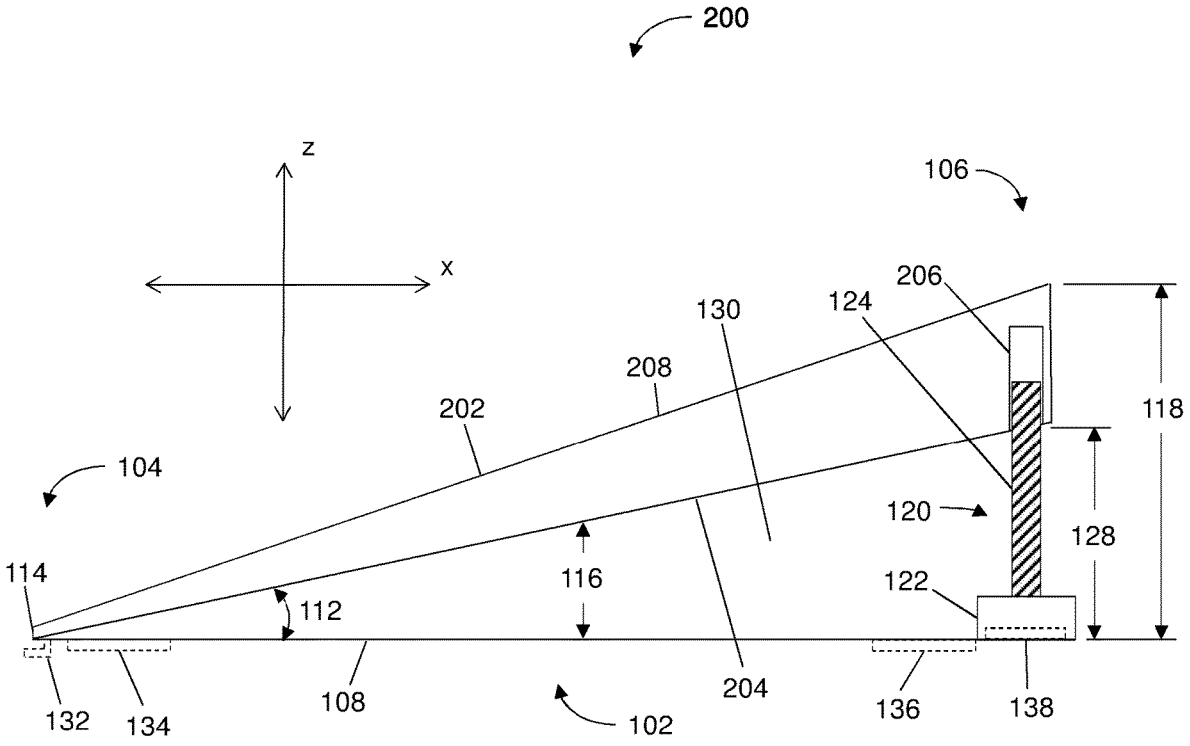
FIG. 2 is a diagrammatic side view of an exemplary adjustable product display of the present disclosure.

FIG. 2 is a diagrammatic side view of an exemplary adjustable product display apparatus 200 (hereinafter "apparatus 200") of the present disclosure. The apparatus 200 can be substantially similar in structure and function to the apparatus 100, except for the distinctions noted herein. Therefore, like reference numbers represent like structures. Rather than having a substantially planar, plate-like form, the top surface 202 can define a substantially tapering or triangular cross-section with the thickness, as measured along the z-axis, increasing from the proximal end 104 to the distal end 106.

At or near the distal end, the inner surface 204 of the top surface 202 includes a threaded opening 206. The opening 206 extends only a portion of the distance towards the outer surface 208 of the top surface 202 such that the entire outer surface 208 maintains a substantially planar configuration and is not interrupted with openings (e.g., opening 126 of FIG. 1). The rod 124 can be threaded in and out of the opening 206 to adjust the distance 128 and distance 118 depending on the type of products to be supported on the outer surface 208 of the top surface 202.

Figure 3:
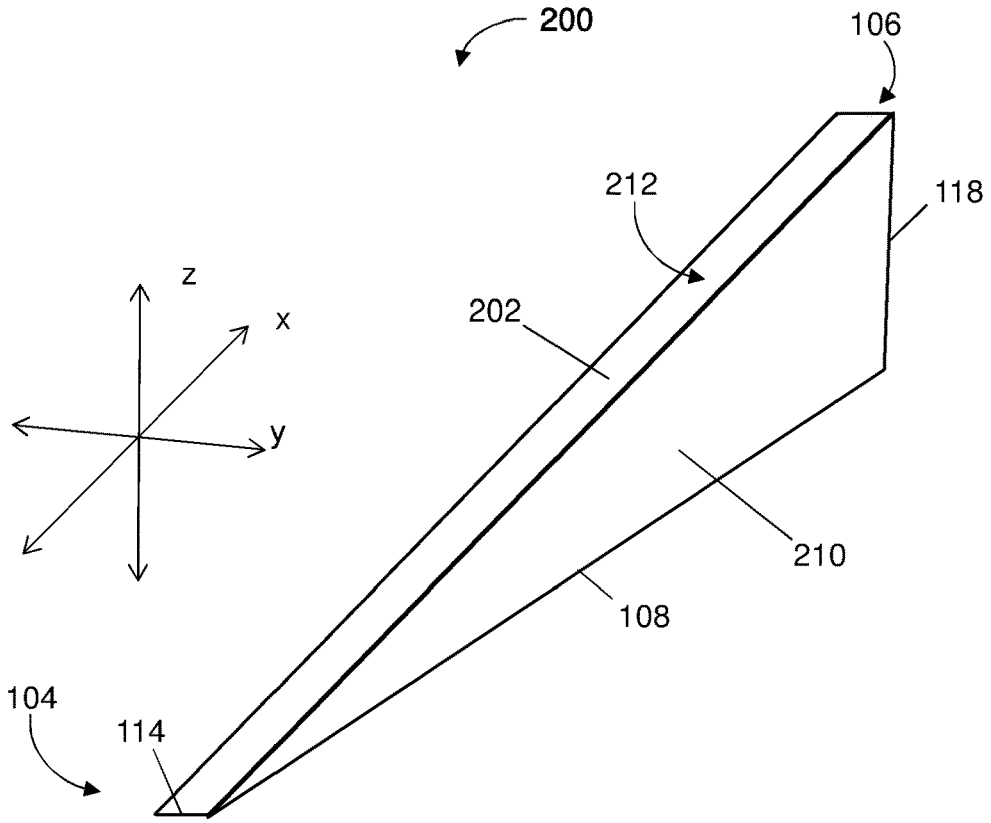
FIG. 3 is a diagrammatic perspective view of an exemplary adjustable product display of the present disclosure including a low friction top surface.
Figure 4:
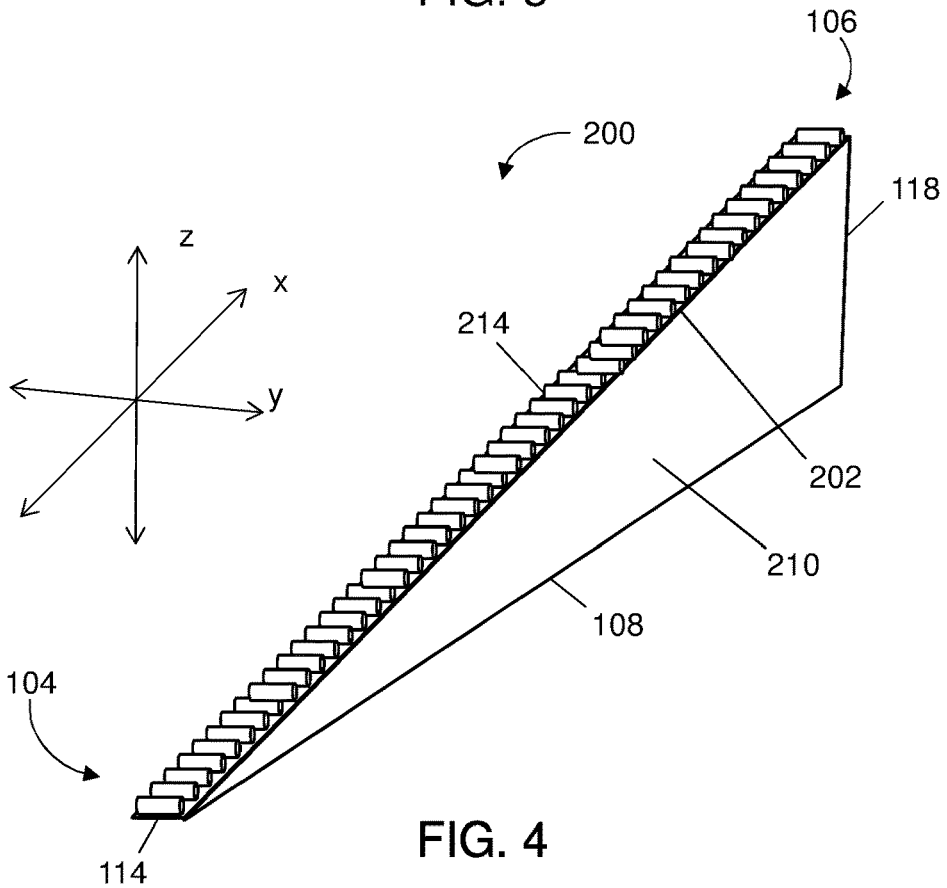
FIG. 4 is a diagrammatic perspective view of an exemplary adjustable product display of the present disclosure including a plurality of rollers on the top surface.
Figure 5:
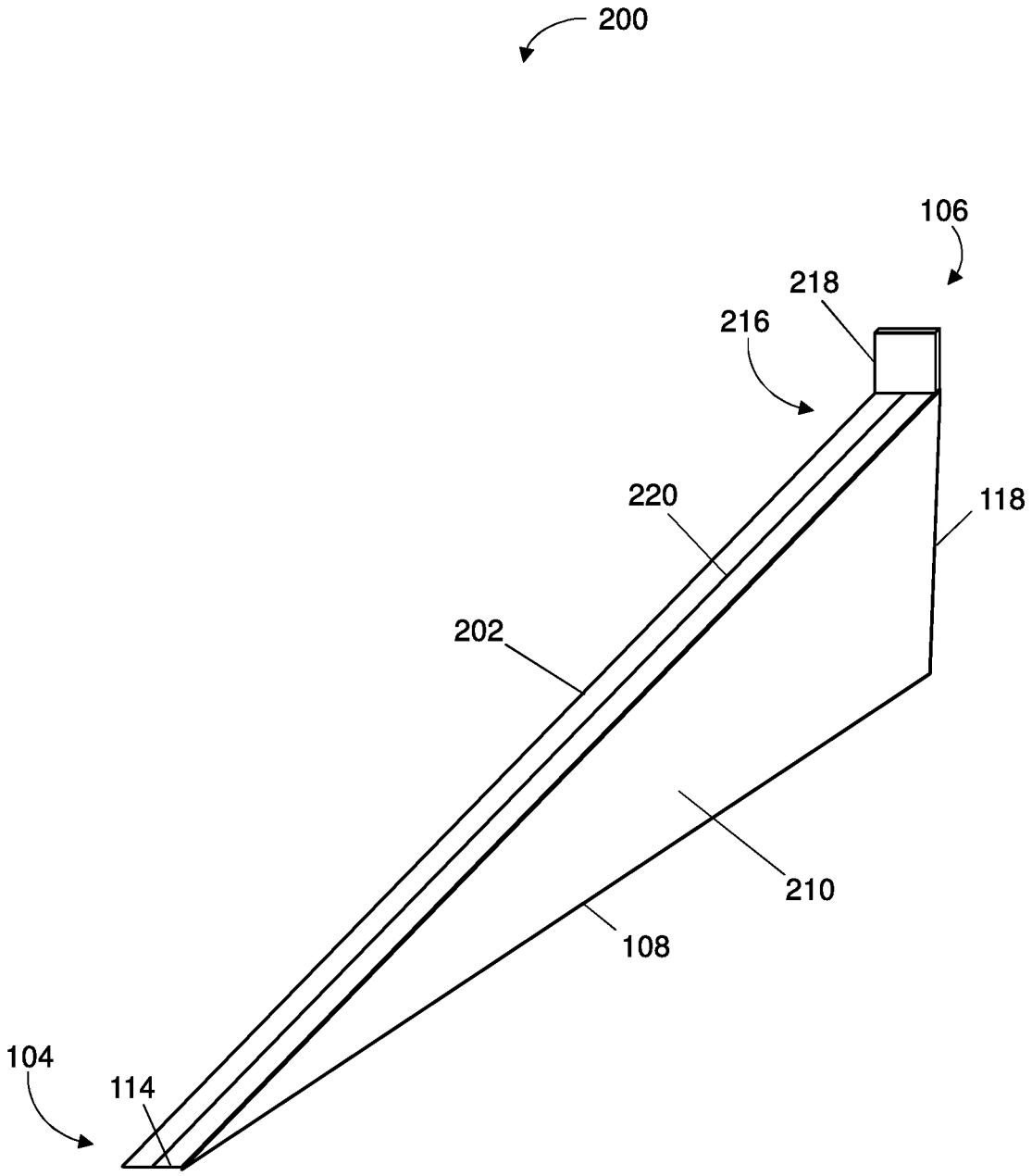
FIG. 5 is a diagrammatic perspective view of an exemplary adjustable product display of the present disclosure including a spring-loaded pusher on the top surface.

FIGS. 3-5 are diagrammatic perspective views of the apparatus 200 including different surface features on the top surface 202 for assisting in urging products in the direction of the proximal end 104 after products at the front of the apparatus 200 are removed. FIGS. 3-5 also show the second side wall 210 covering the area between the bottom and top surfaces 108, 202 that includes the expandable support 120.

FIG. 3 shows the top surface 202 having a width measured along a y-axis between the first and second sides and a low friction surface 212 configured to direct sliding of the products along the top surface from the distal end 106 to the proximal end 104. FIG. 4 shows the top surface 202 having a width measured along a y-axis between the first and second sides and including a plurality of rollers 214 configured to direct movement of the products along the top surface 202 from the distal end 106 to the proximal end 104. Each of the rollers 214 can be configured to rotate independently about their respective axes of rotation, which extend generally parallel to the y-axis, to maintain movement of the products in the direction of the proximal end 104.

FIG. 5 shows the top surface 202 having a width measured along a y-axis between the first and second sides and including a spring-loaded pusher mechanism 216 for urging movement of the products along the top surface 202 from the distal end 106 to the proximal end 104. The pusher mechanism 216 can include a pusher 218 configured to travel along a track 220 on the top surface 202. As products are removed at the proximal end 104 of the apparatus 200, the pusher 218 is urged along the track 220 towards the proximal end 104, thereby pushing the products towards the proximal end 104.

Figure 6:
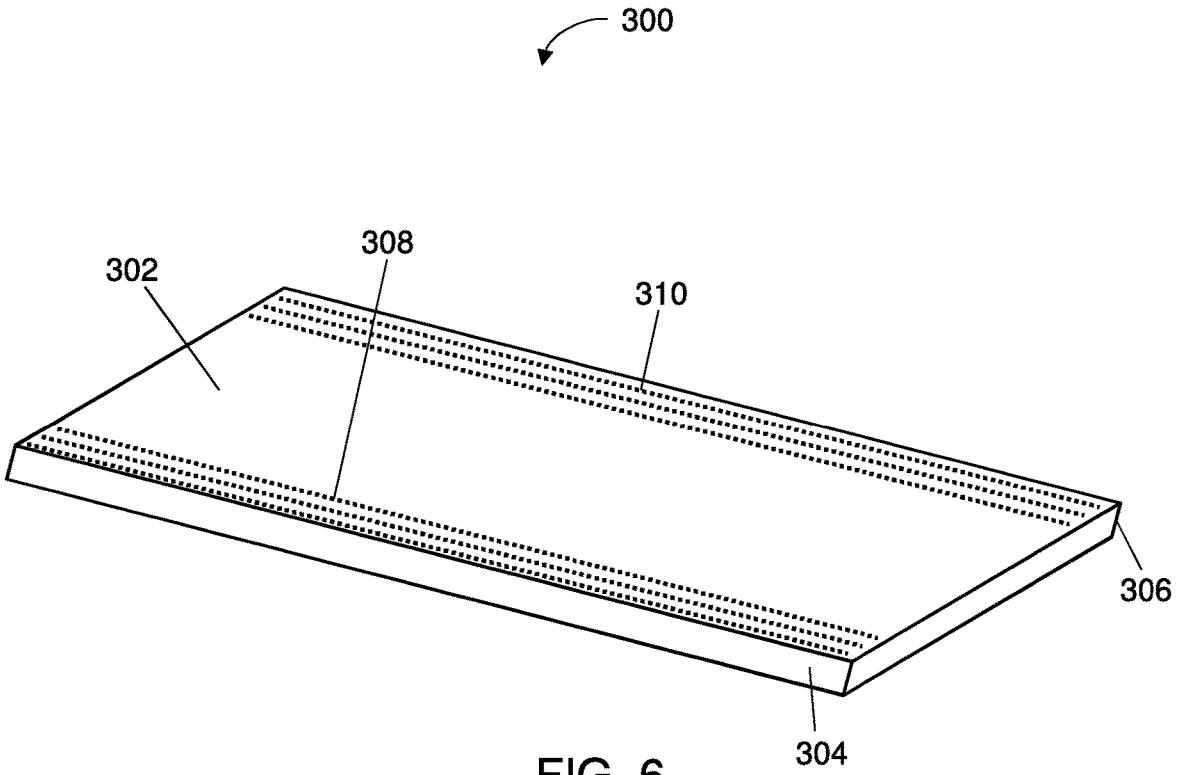
FIG. 6 is a diagrammatic perspective view of an exemplary shelf of the present disclosure.

FIG. 6 is a diagrammatic perspective view of an exemplary shelf 300 of the present disclosure. The shelf 300 includes a top surface 302 on which the apparatus 100, 200 is configured to be mounted. The shelf 300 includes a front end 304 and a rear end 306. The rear end 306 can be mounted to a supporting structure (e.g., a wall or vertical support) and the front end 304 faces customers. The apparatus 100, 200 can be mounted to the top surface 302 such that the proximal end 104 is disposed at or near the front end 304 of the shelf 300 and the distal end 106 is disposed at or near the rear end 306.

The top surface 302 can include one or more rows of openings 308 (e.g., diamond-shaped perforations) passing through the shelf 300 at or near the front end 304. The top surface 302 can include one or more rows of openings 310 (e.g., diamond-shaped perforations) passing through the shelf 300 at or near the rear end 306. The attachment feature 132 of the apparatus 100, 200 can be engaged with one of the openings 308 to engage the proximal end 104 of the apparatus 100, 200 with the shelf 300. In some embodiments, the apparatus 100, 200 can include an attachment feature 132 at or near the distal end 106 of the bottom surface 108 to engage a corresponding opening 310. In some embodiments, the top surface 302 of the shelf 300 can be fabricated from a metal material and one or more of the magnets 134, 136, 138 can be used to detachably mount the apparatus 100, 200 to the shelf 300.

Figure 7:
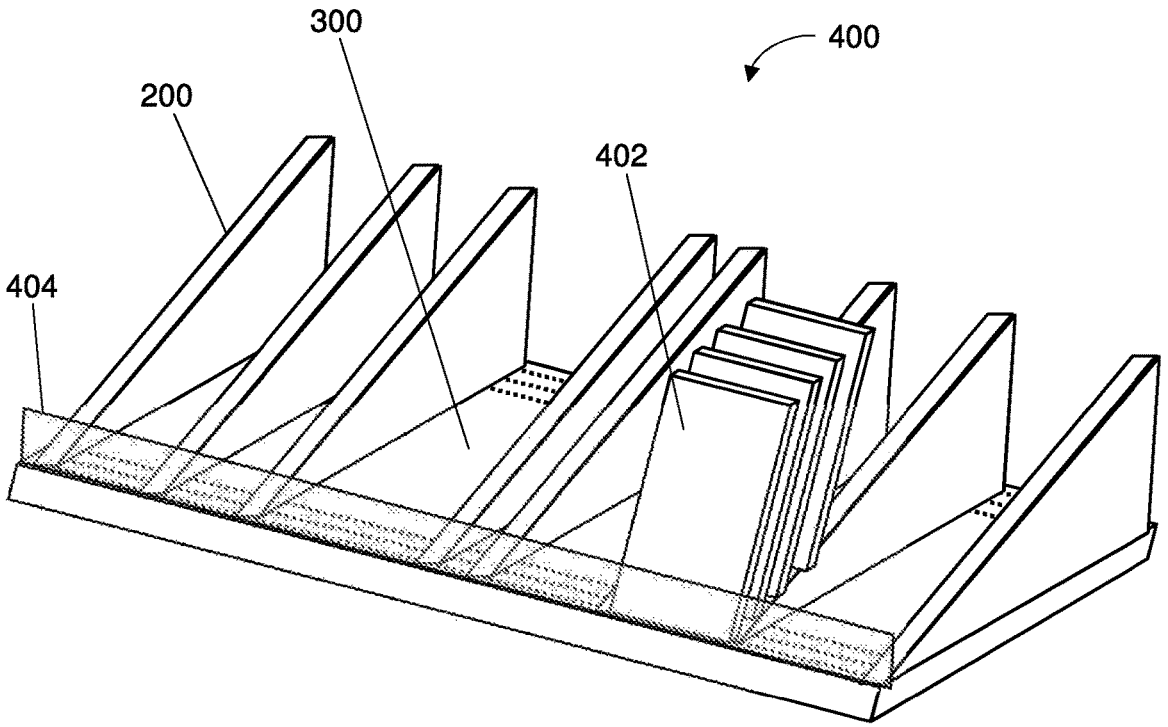
FIG. 7 is a diagrammatic perspective view of an exemplary adjustable product display system of the present disclosure.

FIG. 7 is a diagrammatic perspective view of an exemplary adjustable product display system 400 (hereinafter "system 400") of the present disclosure. Multiple apparatuses 100, 200 can be mounted to the top surface 302 of the shelf 300. In one embodiment, a single apparatus 100, 200 can define a width sufficient to support a product 402 on the top surface 202. In such embodiments, the apparatus 100, 200 can include one or more expandable supports 120 to ensure stability of the apparatus 100, 200. In one embodiment, two or more apparatuses 100, 200 can be used to support a row of products 402 (as shown in FIG. 7). In one embodiment, a stop or guard 404 can be mounted at or near the front edge 304 of the shelf 300 to prevent products 402 from falling off the shelf 300.

Figure 8:
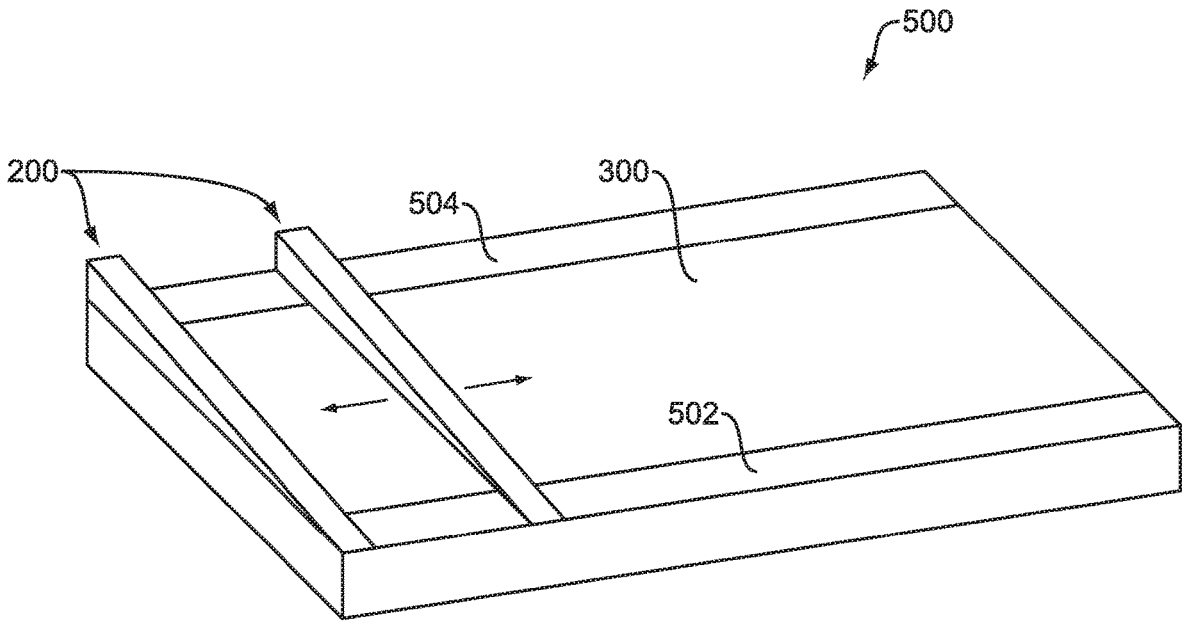
FIG. 8 is a diagrammatic perspective view of an exemplary adjustable product display system of the present disclosure.

FIG. 8 is a diagrammatic perspective view of an exemplary adjustable product display system 500 (hereinafter "system 500") of the present disclosure. The system 500 can be substantially similar in structure and function to the system 400, except for the distinctions noted herein. In particular, rather than or in addition to the openings 308, 310 in the shelf 300, the shelf 300 can include anchor points 502, 504 at or near the front and rear edges 304, 306 of the shelf 300. The anchor points 502, 504 can include magnetic materials or materials capable of engaging the magnets 134, 136, 138 of the apparatus 100, 200.

Figure 9:
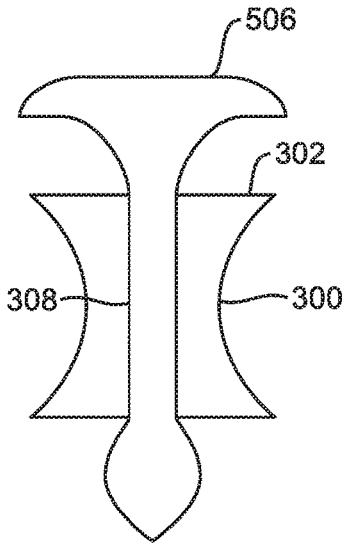
FIG. 9 is a diagrammatic cross-sectional view of an exemplary attachment rivet of the present disclosure.

In one embodiment, the anchor points 502, 504 can be in the form of rails along which the apparatus 100, 200 can laterally travel. In one embodiment, the anchor points 502, 504 can include the openings 308, 310 for introduction of push pins or rivets 506 (see, e.g., FIG. 9). The rivets 506 can extend from the bottom surface 108 of the apparatus 100, 200 and allow the apparatus 100, 200 to be detachably mounted to the shelf 300. Each rivet 506 can define a cross-section having varying widths such that the rivet 506 can be engaged within the opening 308, 310 and prevent undesired detachment of the apparatus 100, 200 from the shelf 300.

Figure 10:
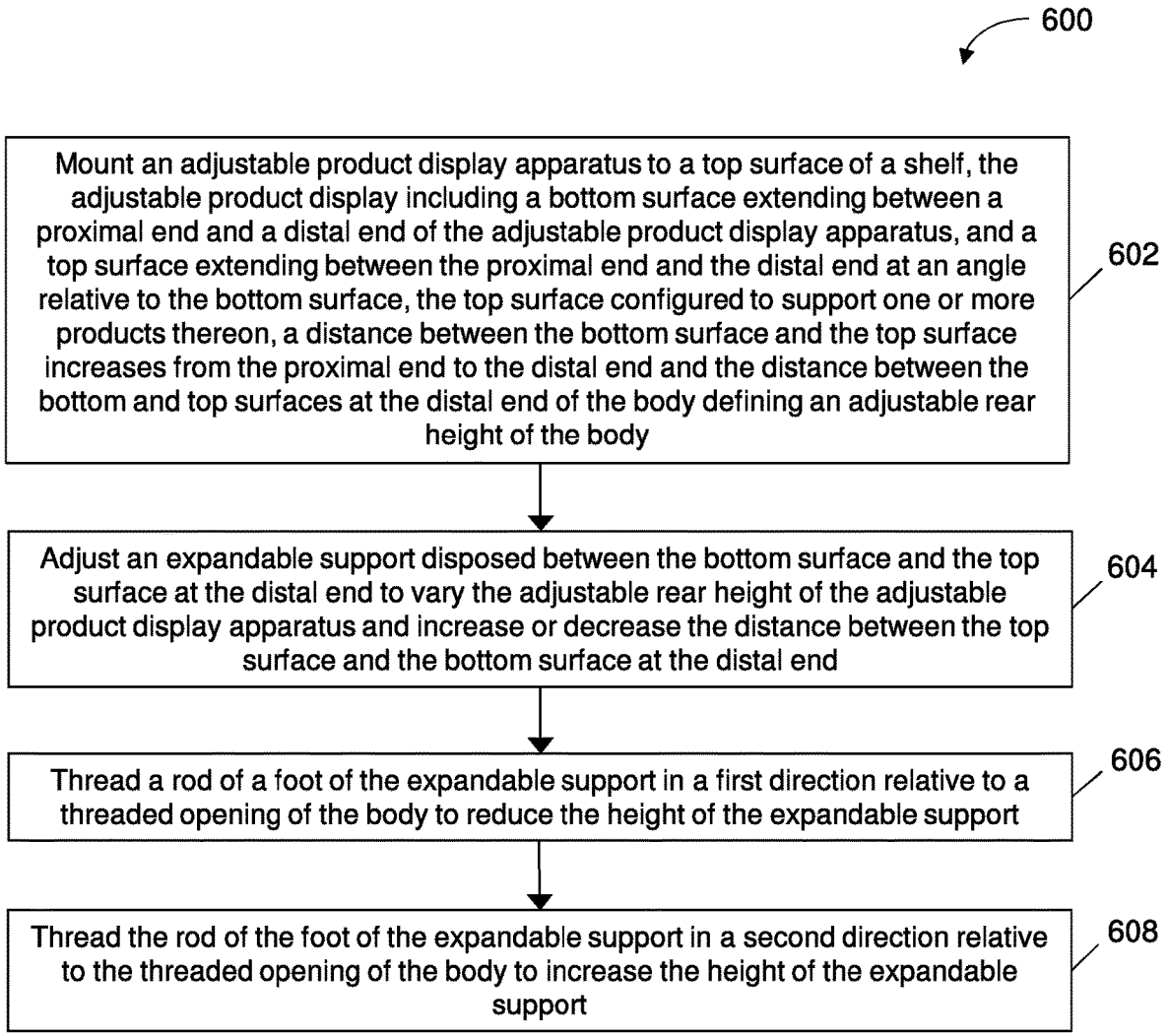
FIG. 10 is a flowchart illustrating a process of adjusting an exemplary product display system in accordance with embodiments of the present disclosure.

FIG. 10 is a flowchart illustrating an exemplary process 600 of adjusting an exemplary product display system. To begin, at step 602, an adjustable product display apparatus is mounted to the top surface of the shelf. The mounting step can involve, e.g., inserting an attachment feature of the apparatus into openings in the shelf, magnetically attaching the body of the apparatus to the shelf, or the like. At step 604, an expandable support disposed between the bottom surface and the top surface at the distal end of the apparatus is adjusted to vary the adjustable rear height of the apparatus. Adjustment of the expandable support increases or decreases the distance between the top and bottom surfaces at the distal end and varies the angle between the top and bottom surfaces.

At step 606, a threaded rod of the expandable support can be threaded in a first direction relative to a threaded opening of the body to reduce the height of the expandable support. At step 608, the threaded rod of the expandable support can be threaded in a second direction relative to the threaded opening of the body to increase the height of the expandable support.

Thus, the exemplary product display apparatus provides an adjustable support for different types of products. In particular, using the expandable support at the rear of the product display apparatus, the rear height of the body can be adjusted, thereby simultaneously adjusting the angle of the top surface relative to the bottom surface. Based on the type of product being displayed, the angle can be adjusted to ensure sufficient gravitational force exists to urge the remaining products forward when the product at the front of the display has been removed. Thus, the product display apparatus provides a single assembly that can be used for a variety of products and ensures proper display of the products.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. An adjustable product display apparatus, comprising:

a body configured to be mounted to a shelf, the body including:

a proximal end;

a distal end;

a bottom surface extending between the proximal end and the distal end; and a top surface extending between the proximal end and the distal end at an angle relative to the bottom surface, the top surface configured to support one or more products thereon, a length of the top surface is defined by a distance between the proximal and distal ends, a width of the top surface is defined by a distance between opposing sides of the top surface, the top surface defining a planar form uninterrupted by openings along the entire length and width of the top surface, the top surface configured to direct sliding of the one or more products along the top surface from the distal end to the proximal end, a distance between the bottom surface and the top surface increases from the proximal end to the distal and the distance at the distal end of the body defining a rear height of the body; and an expandable support disposed at the distal end of the body, adjustment of the expandable support varying a height of the expandable support, the expandable support including an opening formed in the body at or near the distal end and a foot including a rod for threaded engagement into the opening;

wherein threading the rod into the opening of the body reduces the height of the expandable support and simultaneously reduces the rear height of the body; and wherein threading the rod out of the opening of the body increases the height of the expandable support and simultaneously increases the rear height of the body.

2. The adjustable product display apparatus of claim 1, wherein adjustment of the rear height of the body changes the angle of the top surface relative to the bottom surface.

3. The adjustable product display apparatus of claim 2, wherein the angle of the top surface relative to the bottom surface is adjustable with the expandable support by up to about thirty degrees.

4. The adjustable product display apparatus of claim 1, wherein the opening in the body extends only a portion of the distance from the bottom surface towards the top surface.

5. The adjustable product display apparatus of claim 1, wherein the body is tapered with a thickness as measured between the top and bottom surfaces increasing from the proximal end to the distal end.

6. The adjustable product display apparatus of claim 1, wherein the body includes first and second side walls extending between the proximal and distal ends, the first and second side walls covering at least a portion of the expandable support.

7. The adjustable product display of apparatus claim 1, wherein the body includes one or more rivets extending from the bottom surface configured for engagement with openings in a surface of the shelf for mounting the body to the shelf.

8. The adjustable product display of apparatus claim 1, wherein the body includes one or more magnets at or near the bottom surface configured to engage a surface of the shelf for mounting of the body to the shelf.

9. The adjustable product display of apparatus claim 1, comprising an interlocking joint at the proximal end of the body configured to detachably mount the proximal end of the body to the shelf.

10. The adjustable product display of apparatus claim 1, wherein the top surface of the body includes a spring-loaded pusher configured to direct movement of the one or more products along the top surface from the distal end to the proximal end.

11. The adjustable product display of apparatus claim 1, wherein the top surface of the body is pivotally coupled to the bottom surface at the proximal end.

12. The adjustable product display apparatus of claim 1, wherein the foot of the expandable support is fixedly secured to the rod.

13. The adjustable product display apparatus of claim 1, wherein the top surface extends entirely from a left side to a right side of the body, and the top surface extends entirely from the proximal end to the distal end of the body.

14. An adjustable product display system, comprising:

a shelf including a top surface; and an adjustable product display apparatus including:

a body configured to be mounted to the top surface of the shelf, the body including (i) a proximal end, (ii) a distal end, (iii) a bottom surface extending between the proximal end and the distal end, and (iii) a top surface extending between the proximal end and the distal end at an angle relative to the bottom surface, the top surface configured to support one or more products thereon, a length of the top surface is defined by a distance between the proximal and distal ends, a width of the top surface is defined by a distance between opposing sides of the top surface, the top surface defining a planar form uninterrupted by openings along the entire length and width of the top surface, the top surface configured to direct sliding of the one or more products along the top surface from the distal end to the proximal end, a distance between the bottom surface and the top surface increases from the proximal end to the distal end and the distance at the distal end of the body defining a rear height of the body; and an expandable support disposed at the distal end of the body, adjustment of the expandable support varying a height of the expandable support, the expandable support including (i) an opening formed in the body at or near the distal end, and (ii) a foot including a rod for threaded engagement into the opening, wherein threading the rod into the opening of the body reduces the height of the expandable support and simultaneously reduces the rear height of the body; and wherein threading the rod out of the opening of the body increases the height of the expandable support and simultaneously increases the rear height of the body.

15. The system of claim 14, wherein adjustment of the rear height of the body changes the angle of the top surface relative to the bottom surface.

16. The adjustable product display system of claim 14, wherein the shelf comprises anchor points in the form of lateral rails disposed at or near front and rear edges of the shelf, and wherein the adjustable product display apparatus engages with and travels laterally along the lateral rails of the shelf.

17. A method of adjusting a product display, comprising:

mounting an adjustable product display apparatus to a top surface of a shelf, the adjustable product display including a bottom surface extending between a proximal end and a distal end of the adjustable product display apparatus, and a top surface extending between the proximal end and the distal end at an angle relative to the bottom surface, the top surface configured to support one or more products thereon, a length of the top surface is defined by a distance between the proximal and distal ends, a width of the top surface is defined by a distance between opposing sides of the top surface, the top surface defining a planar form uninterrupted by openings along the entire length and width of the top surface, the top surface configured to direct sliding of the one or more products along the top surface from the distal end to the proximal end, a distance between the bottom surface and the top surface increases from the proximal end to the distal end and the distance between the bottom and top surfaces at the distal end of the body defining an adjustable rear height of the body;

adjusting an expandable support disposed between the bottom surface and the top surface at the distal end by threading a rod of the expandable support into an opening of the body to reduce the adjustable rear height of the adjustable product display apparatus and simultaneously reduce the distance between the top surface and the bottom surface at the distal end; and adjusting the expandable support by threading the rod of the expandable support out of the opening of the body to increase the adjustable rear height of the adjustable product display apparatus and simultaneously increase the distance between the top surface and the bottom surface at the distal end.

18. The method of claim 17, wherein adjusting the rear height of the body changes the angle of the top surface relative to the bottom surface.

* * * * *